United States Patent [19]

Maudal

[11] Patent Number: 4,494,460

[45] Date of Patent: Jan. 22, 1985

[54] HIGH ACCELERATION SUPPORT AND POSITIONING DEVICE

[75] Inventor: Inge Maudal, Pomona, Calif.

[73] Assignee: General Dynamics, Pomona Division, Pomona, Calif.

[21] Appl. No.: 395,430

[22] Filed: Jul. 6, 1982

[51] Int. Cl.[3] ..... F42B 33/00

[52] U.S. Cl. ..... 102/293; 244/3.1

[58] Field of Search ..... 102/293, 210, 213, 247, 102/321, 343, 349, 358, 479; 244/3.1, 3.15, 3.16, 3.2; 74/5 R, 5.1

[56] References Cited

U.S. PATENT DOCUMENTS

| | | | |
|---|---|---|---|
| 602,092 | 4/1898 | McKeone | 102/479 |
| 1,881,464 | 10/1932 | Gagen . | |
| 2,335,779 | 11/1943 | Mazzei | 102/7 |
| 2,703,478 | 3/1955 | Grimes et al. | 60/35.6 |
| 2,949,819 | 8/1960 | Smith | 102/213 |
| 3,182,449 | 5/1965 | Kerney et al. | 60/35.6 |
| 3,200,584 | 8/1965 | Mitchell | 60/35.6 |
| 3,608,493 | 9/1971 | Aske | 102/78 |
| 3,610,609 | 10/1971 | Sobel | 267/140 |
| 3,735,952 | 5/1973 | Platus et al. | 248/358 R |
| 3,851,911 | 12/1974 | Brooks | 293/84 |
| 3,913,707 | 10/1975 | Wastenson et al. | 188/1 C |
| 4,204,659 | 5/1980 | Phillips et al. | 248/562 |
| 4,267,988 | 5/1981 | Rodgers | 244/3.16 |

FOREIGN PATENT DOCUMENTS

| | | |
|---|---|---|
| 522708 | 4/1955 | Italy . |
| 1162807 | 8/1969 | United Kingdom . |

*Primary Examiner*—Charles T. Jordan

*Attorney, Agent, or Firm*—Neil F. Martin; Edward B. Johnson

[57] ABSTRACT

A fragile, movable apparatus such as a rotatable infrared optical prism assembly is mounted in a projectile housing on a crushable support pad. When the projectile is launched, the fragile, movable apparatus crushes the pad and receives effective support from the pad. After launch, a resilient member positions the fragile, movable apparatus away from the crushed pad and provides the necessary freedom of movement for the fragile, movable apparatus.

8 Claims, 4 Drawing Figures

HIGH ACCELERATION SUPPORT AND POSITIONING DEVICE

BACKGROUND OF THE INVENTION

The present invention relates to a support and positioning structure for protecting fragile, movable apparatus in a projectile during launch and positioning the fragile, movable apparatus in a free operating position after launch.

Fragile, movable apparatus, such as a rotatable optical prism assembly in an infrared sensor, for example, must be effectively supported during a high acceleration launch, such as a mortar or cannon launch, to avoid damage to the apparatus. The support must be removed after launch to allow the desired freedom of movement for the fragile, movable apparatus. In the case of a rotating optical prism assembly, the support must be removed to permit the prism assembly to spin. Existing structures are complex, heavy, mechanical holding devices that support such fragile, movable apparatus during launch. Electromechanical configurations pull the holding device away from the support position, after the shock of launch, in response to a signal.

A structure has been sought which is simple, lightweight and compact in order to assure effectiveness of operation and to permit manufacture at a reasonable cost.

SUMMARY

The present invention provides a support and positioning structure for a projectile including crushable support means for supporting fragile, movable apparatus during launch of the projectile, said crushable support means being crushed by the fragile, movable apparatus as a result of high G forces during launch, and means for returning the fragile, movable apparatus to its functional location after launch.

DESCRIPTION OF THE PREFERRED EMBODIMENT

Figure 1:
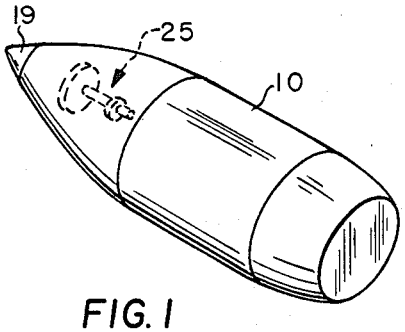
FIG. 1 is a perspective view of a projectile embodying the support and positioning structure of the present invention.

Referring to FIG. 1 of the drawings, a projectile housing is shown at 10 having mounted at the front thereof a nose section 19 which is transparent to the various forms of radiant energy. By way of example, and in the particular configuration illustrated, the nose section 19 is transparent to infrared energy. In accord with the selected example, the projectile housing 10 is shown as containing a frontally mounted infrared optical detection device indicated generally in dotted line at 25. Modifications or additional embodiments of the present invention would include utilization of other radiant energy sources such as light, sound or radio waves, either used separately or in combination.

Figure 2:
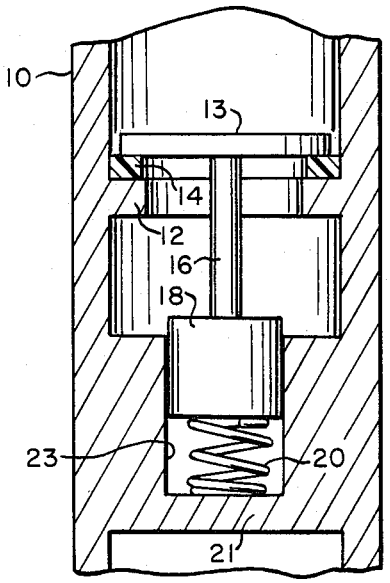
FIG. 2 is a partial sectional elevation showing the support and positioning structure of the present invention prior to launch.

The projectile housing 10 is substantially round in cross section and is formed with a ledge 12 around the inner side wall of the housing 10 as shown in FIG. 2. A pad 14 of shock-absorbing, crushable material, is positioned on the ledge 12 and is affixed to the ledge 12 with a suitable adhesive. A rotatable optical prism assembly for detecting infrared energy, for example, is shown at 13 connected through a shaft 16 to a prime mover, such as a motor assembly 18. The motor assembly 18 is coupled with a resilient device or member, such as spring 20 which is mounted on a base 21 in the projectile housing 10. The prism assembly 13, shaft 16 and motor assembly 18 are slidable in channel 23. The rotatable prism assembly 13 is fragile and must be adequately supported during launch of the projectile to avoid damage. The rotatable prism assembly 13 is supported on the crushable support pad 14 prior to launching the projectile. The crushable support pad 14 is preferably made of aluminium honeycomb, foamed aluminium, or foamed plastic, for example. Such materials provide both sufficient structural strength for support and resiliency for withstanding the crushing forces effected during launch without breaking or completely collapsing.

Figure 3:
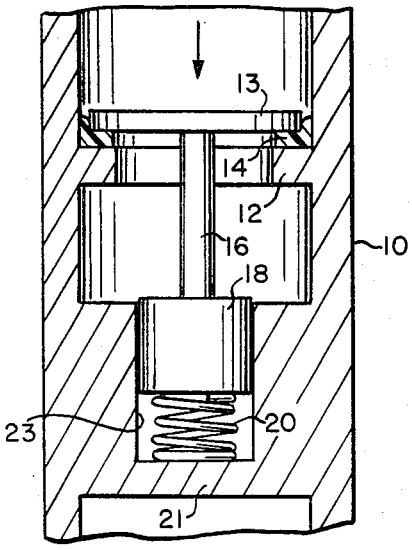
FIG. 3 is a view similar to FIG. 2 showing the support and positioning structure during launch.

When the projectile is launched, high G forces move the rotatable prism assembly 13 down against the crushable support pad 14, crushing the crushable support pad as shown in FIG. 3 of the drawing. The crushable support pad 14 provides effective support during launch and has sufficient resiliency so that the rotatable prism assembly 13 can crush it without damage to the rotatable prism. The rotatable prism assembly 13 and motor assembly 18 compress the spring 20 during launch. The essential properties of the crushable support pad 14 and the structural strength and resiliency of the spring 20 are balanced to obtain the desired support and protection for the rotatable prism assembly 13.

Figure 4:
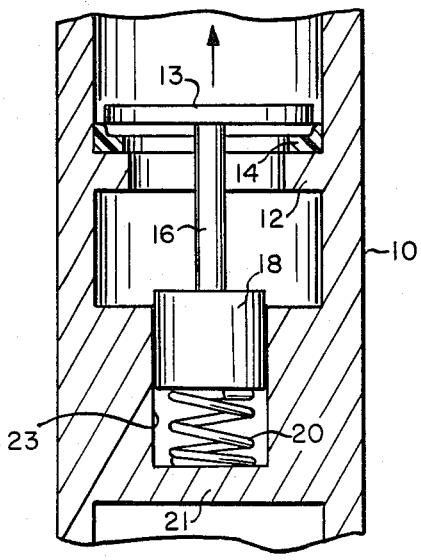
FIG. 4 is a view similar to FIG. 2 showing the support and positioning structure after launch.

After launch, when the acceleration forces have decreased, the spring 20 urges the motor assembly 18 and rotatable prism assembly 13 back to their initial positions, free of the support pad 14, as shown in FIG. 4 of the drawing. In this position, the rotatable prism assembly 13 is free to be rotated by the motor assembly 18 when the motor assembly 18 is energized by a suitable signal. Thus, the crushable support pad 14 provides effective protection during launch but is out of the way so that the rotatable prism assembly can function without interference after launch.

The construction of the present invention has no moving parts in the form of clamps, release mechanisms, etc., and is simple and inexpensive to manufacture. Its simplicity leaves little chance of failure in operation.

Having thus described my invention, I claim:

1. A protective device for supporting fragile, movable apparatus in a projectile housing during a high acceleration launch of the projectile, comprising:

crushable support means attached to the inside of the projectile housing for supporting said fragile, movable apparatus in said projectile housing prior to and during launch, which crushable support means is crushed during launch; and resilient positioning means mounted within each projectile housing for holding said fragile, movable apparatus in position prior to launch and for compressing during launch, said resilient positioning means returning said fragile, movable apparatus substantially to its original position free of said crushed support means after launch.

2. A protective device according to claim 1, wherein said crushable support means is crushable aluminium honeycomb.

3. A protective device according to claim 1 wherein said crushable support means is crushable foamed aluminium.

4. A protective device according to claim 1, wherein said crushable support means is crushable foamed plastic.

5. A protective device according to claim 1, wherein said fragile, movable apparatus includes a rotatable member positioned on a crushable support pad, said rotatable member being free of said crushable support pad after launch so that it can rotate without restriction.

6. A protective device according to claim 5, wherein each crushable support pad is mounted on a peripheral ledge extending inwardly from the side wall of said projectile housing, said crushable support pad having a central opening therein;

said rotatable member including a shaft extending downwardly through said central opening along the longitudinal axis of the projectile and affixed to rotating means; and spring means coupled to said rotating means and to said projectile housing.

7. A protective device according to claim 6 wherein said rotating means is a motor assembly slidable in a channel in said projectile housing.

8. A protective device according to claim 7, wherein said spring means is mounted in said channel and supports said motor assembly.

* * * * *